United States Patent [19]

Huang

[11] 4,289,808

[45] Sep. 15, 1981

[54] PROCESS FOR PRODUCING DRY FINISHED PAPERBOARD

[75] Inventor: Denis K. Huang, Laurel, Md.

[73] Assignee: Westvaco Corporation, New York, N.Y.

[21] Appl. No.: 102,743

[22] Filed: Dec. 12, 1979

Related U.S. Application Data

[63] Continuation of Ser. No. 926,075, Jul. 19, 1978, abandoned.

[51] Int. Cl.[3] ..... B05D 1/00

[52] U.S. Cl. ..... 427/209; 427/211; 427/361; 427/385.5; 427/391; 427/411; 427/414

[58] Field of Search ..... 427/211, 326, 209, 361, 427/385.5, 391, 411, 414

[56] References Cited

U.S. PATENT DOCUMENTS 2,249,118 7/1941 De Witt ..... 91/68

3,017,295 1/1962 Outterson et al. ..... 117/155

*Primary Examiner*—Bernard D. Pianalto

[57] ABSTRACT

Dry finished coated paperboard is prepared with a smoothness and printability substantially equivalent to a comparable wet finished product, and without significant loss of bulk, with the addition of a plasticizing agent to the surface sizing formulation prior to calendering and before coating. The plasticizing agent preferably has a boiling point greater than water and is soluble in water. In addition, the surface size treatment is preferably applied with a blade, gateroll or like arrangement so that the plasticizing agent remains substantially on the surface of the paperboard with little or no penetration.

1 Claim, 1 Drawing Figure

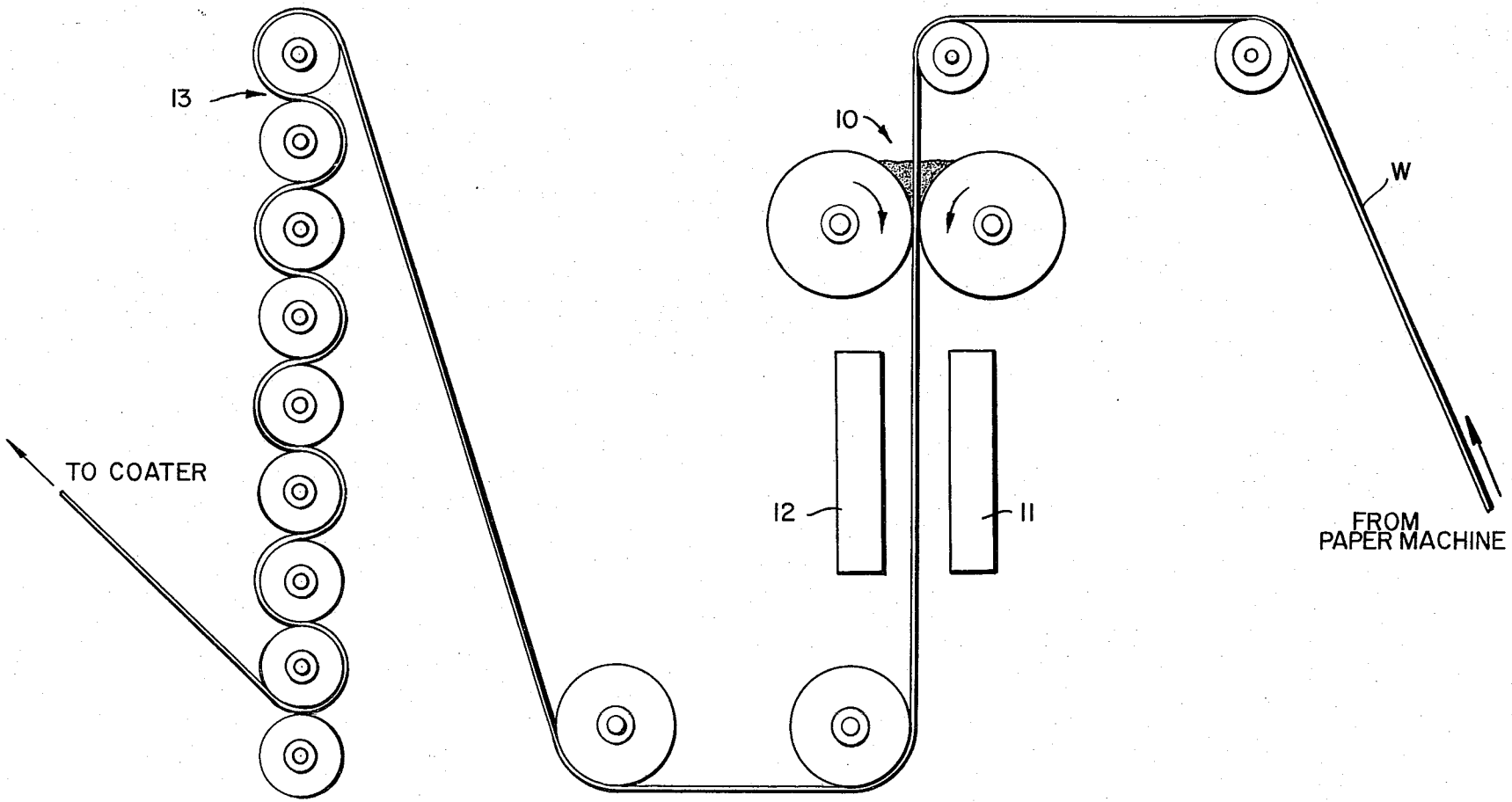
W
FROM PAPER MACHINE
10
11
12
13
TO COATER

PROCESS FOR PRODUCING DRY FINISHED PAPERBOARD

This is a continuation of application Ser. No. 926,075 filed July 19, 1978, abandoned.

BACKGROUND OF INVENTION

The present invention relates generally to the manufacture of coated, bleached paperboard, and more particularly, to the manufacture of such paperboard with a dry finishing technique.

In the conventional manufacture of coated paperboard, the rawstock from the papermachine is surface sized and then machine calendered prior to coating. The surface sizing step is desired to enhance the strength characteristics of the paperboard, to apply a surface film which bonds surface fibers to the body of the paperboard itself and to achieve a holdout for the later applied coating. Meanwhile, the purpose of machine calendering is to achieve a surface smoothness before the coating operation.

In a typical wet finishing process, the effectiveness of the calendering step is enhanced with the application of water from one or more water boxes or the like on the calender stack. The water application imparts good surface smoothness and printability to the paperboard, but not without some detrimental side effects. For instance, when the paperboard is wet finished on the calender, the caliper or bulk of the paperboard is reduced as the density is increased. This decrease in caliper is not ordinarily a problem, except that paperboard is sold according to area and not by weight. Thus, in order to achieve a designated final caliper to paperboard that is wet finished, the rawstock must be manufactured wtih a greater original caliper which increases raw material costs. In addition, wet finishing creates operating problems such as surface mottle of the paperboard due to the non-uniformity of water adsorption of the rawstock, web breaks and corrosion problems on the machine.

Many attempts have been made to manufacture paperboard without wet finishing, however none have been successful in achieving final sheet characteristics comparable to those of a wet finished sheet. The most desirable situation would be a complete elimination of the water application, or simply dry finishing. Dry finished paperboard generally has about 5—10% less density as compared to wet finished paperboard thus requiring less raw material for a given caliper. Furthermore, the elimination of water at the calender reduces the drying load on the machine and other operating problems, thus increasing the operating efficiency of the machine and reducing manufacturing costs. However, to date, it has not been possible to manufacture a dry finished product with the same printing qualities as wet finished board.

In the wet finishing process, the paperboard surface is very responsive to the smoothing action of the calender. One reason for this response is that the water applied plasticizes the surface sizing and the surface fibers, which become pliable, and readily deformed by the pressure at the calender. On the other hand, with the prior art dry finishing techniques, there is no similar plasticizing effect and the surface sizing layer and the surface of the paperboard remain rigid and spongy, so that the paperboard tends to spring back to its original shape once the compression exerted in the calender is removed. In order to improve the prior art dry finishing techniques several counter measures have been tried. One method has included the use of a thermal plastic polymer in the sizing formulation together with hot calendering. Other methods have involved the careful regulation of the moisture content of the paperboard going into the calender and the application of a small, measured amount of water to the board surface during machine calendering in an effort to achieve a good finish without caliper loss. Although each of these methods have resulted in some improvement to the dry finished technique, none has fully realized the economical advantages of dry finishing nor the printing quality achieved with wet finishing.

SUMMARY OF INVENTION

In accordance with the present invention, a convenient method has been developed for producing dry finished coated paperboard to achieve a surface smoothness and print quality heretofore only available by wet finishing, but without the attendant caliper or bulk loss and increased raw material costs involved with wet finishing. The method comprises the use of a water soluble plasticizer, having a boiling point above about 100 degrees C., in the surface sizing formulation conventionally applied to paperboard before machine calendering and coating. In addition, for further improving the effectiveness of the present method, the surface sizing formulation is preferably applied with a blade coater, gateroll or like arrangement so that the sizing material applied remains substantially on the surface of the paperboard and does not penetrate the surface of the paperboard to the degree normally experienced with a conventional size press. The size press formulation contemplated by the present invention may or may not contain a pigment, and the amount applied should be in the range of from about 0.75–3.5 lb./side/ream (ream size 500 sheets, 25"38). The preferred size press formulation contains starch, although other binder materials such as animal glues or synthetic polymers are also suitable, and the amount of water soluble plasticizer added is on the order of from about 5–20% based on the weight of binder used. The pick up at the size press is generally related to the solids content of the size press formulation and will vary depending on the type of binder used, i.e., starch or latex. However, for the present invention, a solids content of from about 4–32% can be used to achieve a satisfactory product.

After application of the surface sizing formulation according to the present invention, the paperboard is machine calendered in the normal manner, but without the addition of water at the calender stack. Because of the presence of the plasticizer in the sizing formulation, the surface of the paperboard responds to the action of the machine calender as effectively as in the case of wet finishing. The reason for the response is believed to be due to the fact that the plasticizer present in the size press formulation remains primarily on the surface of the paperboard, and only the surface layer becomes compacted and smoothed under the pressure applied at the calender. Thus, the bulk of the paperboard is not affected to any great extent by the calendering action and the losses in caliper due to densification of the paperboard is minimal, if any.

The plasticizers contemplated for use in the present invention include polyhydroxy alcohols and derivatives of the same, such as glycerine, glyceral, glycol, trimethylene glycol. glycide and the ethers and esters of polyhydroxy alcohols. These plasticizers are water soluble, are stable and have boiling points sufficiently in excess of the boiling point of water, whereby they are retained on the paperboard even if it is heated as high or above the boiling point of water.

BRIEF AND DETAILED DESCRIPTION OF THIS FIGURE

As illustrated in the accompanying sheet of drawing, the paperboard rawstock W from the papermachine (not shown) is applied with a surface sizing at a size press 10. The size press illustrated is exemplary of a horizontal application but could comprise a vertical arrangement with any combination of rolls and blades or simply a blade application, if desired, as long as the size press formulation applied remains substantially on the surface of the paperboard. Both sides of the web W are applied with the size press formulation even though in general only one side is later coated. After sizing, the web is dried with driers shown schematically at 11,12 prior to going to the machine calender 13 for finishing. At the calender 13, elimination of the water box from one side of the paperboard, (the felt side) which is generally the uncoated side, is referred to as dry finishing one side (DFIS). Elimination of the water treatment from both sides of the calender is referred to as dry finishing two sides (DF2S). After the calenders, the web is coated, usually on one side, to produce a dry finished coated paperboard product.

The following examples are illustrative of the present invention and are not to be construed as limiting the scope thereof.

EXAMPLE I

A series of trails were conducted to demonstrate the effectiveness of the use of a plasticizer in a size press formulation when manufacturing dry finished, coated paperboard. The effects of plasticizer concentration and the solids content of the size press formulation which controls the pick up were studied. The results are shown in Table I for the plasticizer propylene glycol.

TABLE I

| | Effect of Plasticizer - Propylene Glycol | | | | | | |
|---|---|---|---|---|---|---|---|
| Run # | 185 | 185 | 190 | 191 | 192 | 193 | 194 |
| Calender | Wet | Dry | Dry | Dry | Dry | Dry | Dry |
| Starch (pts.) | 11 | 11 | 6 | 6 | 7 | 8 | 8 |
| Clay (pts.) | 14 | 14 | 6 | 6 | 7 | 8 | 8 |
| Plasticizer % | — | — | 5 | 10 | 7.5 | 5 | 10 |
| Solids % | 12 | 12 | 12 | 12 | 14 | 16 | 16 |
| Caliper | 12.2 | 12.9 | 13.8 | 13.3 | 12.6 | 13.4 | 12.9 |
| Gloss | 70.2 | 62.8 | 61.7 | 66.1 | 68.7 | 64.7 | 68.2 |
| Ink Holdout | 62 | 57 | 59 | 62 | 70 | 61 | 70 |

For the above noted trials, the amount of plasticizer added was based on the amount of starch in the formulation. The data show that for the dry finished product, the caliper increases as compared with wet finishing as expected. Moreover, with an increase in plasticizer level and solids, the gloss and ink holdout generally increase to levels as good as or better than the wet finished product thus providing a dry finished product comparable in quality to a wet finished product. Printability tests on the paperboard demonstrated results comparable to wet finished paperboard.

EXAMPLE II

In another series of trials, several different plasticizers were tried in an effort to determine the effect of plasticizer type on the final finished product. The results are shown in Table II.

TABLE II

| | | Plasticizer Type | | | |
|---|---|---|---|---|---|
| Run # | Calender Condition | Plasticizer Type | Caliper | Gloss | Ink Holdout |
| 212 | Wet | Control | 14.1 | 66 | 53.2 |
| 212 | Dry | Control | 15.1 | 67 | 53.1 |
| 213 | Dry | Glycerine | 15.3 | 68 | 51.1 |
| 214 | Dry | D.E.G. | 15.5 | 68 | 51.4 |
| 215 | Dry | P.P.G. | 15.2 | 67 | 51.2 |
| 216 | Dry | D.P.G. | 15.9 | 67 | 48.2 |

For the above noted trials, the amount of plasticizer based on starch was maintained at 10%. The different designations represent, D.E.G. (Diethylene Glycol), P.P.G. (Propylene Glycol), and D.P.G. (Dipropylene Glycol). Solids content of the size press was maintained at 16% and the ratio of starch to pigment was held at 11/14 . The results show generally increasing caliper with dry finishing while maintaining equivalent or better gloss, but slightly lower ink holdout. However, printing tests on samples of the coated substrate demonstrated printability substantially equivalent to a wet finished product.

It should be noted that for each of the trials hereinbefore described, the substrate after sizing and calendering was applied with a standard coating formulation to the wire side only to produce the final coated paperboard product. In general, the coating operation comprises a base coat of about 3–6 lbs./ream and a top coat of about 6–9 lbs./ream. The size press application varies from abut 3–7 lbs./ream total pickup.

Accordingly, while the invention has been described with reference to specific embodiments and examples, it will be apparent to those skilled in the art that various modifications may be made without departing from the principles and scope of the invention as set forth in the appended claims.

I claim:

1. A process for producing a dry finished, coated paperboard web to attain a smoothness and printability equivalent to that of a wet finished product without any significant loss of caliper comprising:

(a) applying a surface sizing composition with a surface sizing applicator to at least one side of the paperboard web before calendering and coating, said surface sizing composition comprising a binder, pigment in the ratio of from about 1:1 to 1:1.5 based on the weight of the binder and from about 5–20% based on the weight of the binder of a low molecular weight polyhydroxy alcohol plasticizing agent having a boiling point greater than about 100 degrees C. selected from the group consisting of glycerine, glycerol, glycol, propylene glycol, diethylene glycol, triethylene glycol, trimethylene glycol and glycide, the solids content of said surface sizing composition being from about 4–32%, wherein the total pickup at the sizepress ranges from about 0.75 to 3.5 lb/ream/side in such a manner that the plasticizing agent remains substantially on the surface of the paperboard;

(b) machine calendering the surface sized paperboard in the absence of a water treatment so that only the plasticizing agent containing surface layer of the paperboard becomes compacted and smoothed;

(c) coating the calendered and surface size treated paperboard surface; and, (d) drying the thus treated paperboard to produce a dry finished web.

* * * * *